US010612115B2

(12) United States Patent
Brinkman et al.

(10) Patent No.: US 10,612,115 B2
(45) Date of Patent: Apr. 7, 2020

(54) ALMGSI STRIP FOR APPLICATIONS HAVING HIGH FORMABILITY REQUIREMENTS

(71) Applicants: Henk-Jan Brinkman, Bonn (DE); Thomas Wirtz, Hamburg (DE); Dietmar Schröder, Grevenbroich (DE); Eike Brünger, Denzlingen (DE); Kai-Friedrich Karhausen, Bonn (DE)

(72) Inventors: Henk-Jan Brinkman, Bonn (DE); Thomas Wirtz, Hamburg (DE); Dietmar Schröder, Grevenbroich (DE); Eike Brünger, Denzlingen (DE); Kai-Friedrich Karhausen, Bonn (DE)

(73) Assignee: Hydro Aluminium Deutschland GmbH, Grevenbroich (DE)

( * ) Notice: Subject to any disclaimer, the term of this patent is extended or adjusted under 35 U.S.C. 154(b) by 862 days.

(21) Appl. No.: 14/928,122

(22) Filed: Oct. 30, 2015

(65) Prior Publication Data

US 2016/0068939 A1 Mar. 10, 2016

Related U.S. Application Data

(63) Continuation of application No. 13/340,225, filed on Dec. 29, 2011, now Pat. No. 10,047,422, which is a (Continued)

(30) Foreign Application Priority Data

Jun. 30, 2009 (EP) ..... 09164221

(51) Int. Cl.
*C22F 1/043* (2006.01)
*C22C 30/00* (2006.01)
(Continued)

(52) U.S. Cl.
CPC ..... *C22F 1/043* (2013.01); *B22D 7/005* (2013.01); *B22D 21/007* (2013.01); *C21D 1/26* (2013.01);
(Continued)

(58) Field of Classification Search
None
See application file for complete search history.

(56) References Cited

U.S. PATENT DOCUMENTS 3,392,062 A 7/1968 Altenpohl et al.
4,808,247 A 2/1989 Komatsubara et al.
(Continued)

FOREIGN PATENT DOCUMENTS

CA 545439 A 8/1957
EP 0 761 837 A1 3/1997
(Continued)

OTHER PUBLICATIONS

6181 Aluminum Composition Spec., Jan. 2013.
(Continued)

*Primary Examiner* — Xiaowei Su
(74) *Attorney, Agent, or Firm* — Reinhart Boerner Van Deuren P.C.

(57) ABSTRACT

The invention relates to a method for producing a strip made of an AlMgSi alloy in which a rolling ingot is cast of an AlMgSi alloy, the rolling ingot is subjected to homogenization, the rolling ingot which has been brought to rolling temperature is hot-rolled, and then is optionally cold-rolled to the final thickness thereof. The problem of providing a method for producing an aluminum strip made of an AlMgSi alloy and an aluminum strip, which has a higher breaking elongation with constant strength and therefore enables higher degrees of deformation in producing structured metal sheets, is solved in that the hot strip has a temperature of no
(Continued)

more than 130° C. directly at the exit of the last rolling pass, preferably a temperature of no more than 100° C., and the hot strip is coiled at that or a lower temperature.

16 Claims, 2 Drawing Sheets

Related U.S. Application Data continuation of application No. PCT/EP2010/057071, filed on May 21, 2010.

(51) Int. Cl.

| | |
|---|---|
| ***C22C 21/02*** | (2006.01) |
| ***C22F 1/00*** | (2006.01) |
| ***C22C 21/08*** | (2006.01) |
| ***C22F 1/05*** | (2006.01) |
| ***B22D 7/00*** | (2006.01) |
| ***B22D 21/00*** | (2006.01) |
| ***C21D 1/26*** | (2006.01) |
| ***C21D 1/62*** | (2006.01) |

(52) U.S. Cl.

CPC ..... *C21D 1/62* (2013.01); *C22C 21/02* (2013.01); *C22C 21/08* (2013.01); *C22F 1/05* (2013.01)

(56) References Cited

U.S. PATENT DOCUMENTS

| | | | | |
|---|---|---|---|---|
| 4,808,824 | A | 2/1989 | Sinnar | |
| 5,728,241 | A * | 3/1998 | Gupta | C22C 21/02 148/694 |
| 5,919,323 | A | 7/1999 | Murtha | |
| 6,060,438 | A | 5/2000 | Oleksiak | |
| 2004/0011438 | A1 | 1/2004 | Lorentzen et al. | |
| 2004/0250298 | A1 | 12/2004 | Pinkerton et al. | |
| 2004/0250928 | A1 | 12/2004 | Bull et al. | |
| 2006/0032560 | A1 | 2/2006 | Benedictus et al. | |
| 2007/0137738 | A1 | 6/2007 | Bassi et al. | |
| 2007/0151635 | A1 | 7/2007 | Sano et al. | |
| 2007/0194603 | A1 * | 8/2007 | Bouet-Griffon | B62D 25/02 296/187.01 |

FOREIGN PATENT DOCUMENTS

| | | | |
|---|---|---|---|
| EP | 1 533 394 | A1 | 5/2005 |
| JP | H05306440 | A | 11/1993 |
| JP | 2003129156 | A | 5/2003 |
| JP | 2003171726 | A | 6/2003 |
| JP | 2003277869 | A | 10/2003 |
| JP | 2003291347 | A | 10/2003 |
| JP | 2005146375 | A | 6/2005 |
| JP | 2006257506 | A | 9/2006 |
| WO | WO 96/07768 | A1 | 3/1996 |
| WO | WO 97/22724 | A1 | 6/1997 |
| WO | WO 97/47779 | A1 | 12/1997 |
| WO | WO 2013/037919 | A1 | 3/2013 |

OTHER PUBLICATIONS

AA6016 composition, 2015, http://www.matweb.com/.

Shimadzu Corporation, Tensile Test for Metallic Materials Using Strain Rate Control and Stress Rate Control, internet article, Jan. 2012, 4 pages, First Edition, Shimadzu Corporation.

E.R. Morgan et al., Improved High Strength Low Alloy Steels Through Hot Strip Mill Controlled Cooling, Yearbook of American Iron and Steel Institute, book, 1965, pp. 281-305, American Iron and Steel Institute, New York, US.

DIN 50125 Berichtigung 1, Jul. 2004, 14 pages, DIN Deutsches Institut fur Normung e.V., Berlin, Germany.

Wikipedia, Zugprobe, webpage, last modified: May 19, 2015, 5 pages, Germany, https://de.wikipedia.org/wiki/Zugprobe.

Dietrich G. Altenpohl, Aluminium: Technology, Applications, and Environment: A Profile of a Modern Metal, 1998, 5 pages, 6th edition, The Aluminum Association, Inc., Washington, D.C., and The Minerals, Metals & Materials Society, Warrendale, Pennsylvania.

The Aluminum Association, Rolling Aluminum: From the Mine Through the Mill, 3rd Edition, Dec. 2007, 70 pages.

* cited by examiner

ALMGSI STRIP FOR APPLICATIONS HAVING HIGH FORMABILITY REQUIREMENTS

CROSS-REFERENCE TO RELATED PATENT APPLICATIONS

This patent application is a continuation of co-pending U.S. patent application Ser. No. 13/340,225, filed Dec. 29, 2011, which is a continuation of PCT/EP2010/057071 filed May 21, 2010, which claims the benefit of European Application No. 09164221.5, filed Jun. 30, 2009, the entire teachings and disclosures of which are incorporated herein by reference thereto.

FIELD OF THE INVENTION

The invention relates to a method for producing a strip from an AlMgSi alloy, in which a rolling ingot is cast from an AlMgSi alloy is poured, the rolling ingot is subjected to homogenization, the rolling ingot is brought to rolling temperature and hot-rolled then optionally cold-rolled to final thickness. The invention further relates to an aluminium strip made from an AlMgSi alloy and advantageous use thereof.

BACKGROUND OF THE INVENTION

Particularly in automotive engineering but also in other application area, such as aircraft construction or rail vehicle construction, metal sheets made from aluminium alloys are required that not only have particularly high strength values but also very good formability characteristics, and enable a high degree of deformation. In automotive engineering, typical application areas are the body and chassis parts. For visible, painted components, for example body sheet metal that is visible from the outside, the deformation of the materials must also occur in such a way that the surface is not marred by faults after painting, such as slip lines or roping. This is particularly important, for example, when aluminium alloy sheets are used to manufacture engine bonnets and other body components of a vehicle. However, it also limits the choice of material in terms of the aluminium alloy. In particular, AlMgSi alloys, the main alloy components of which are magnesium and silicon, have relatively high strengths and at the same time good formability characteristics and exceptional corrosion resistance. AlMgSi alloys are the AA6XXX alloy types, for example alloy types AA6016, AA6014, AA6181, AA6060 and AA6111. Aluminium strips are usually manufactured from an AlMgSi alloy by casting a rolling ingot, homogenising the rolling ingot, hot-rolling the rolling ingot and cold-rolling the warm strip. The rolling ingot is homogenised at a temperature from 380 to 580° C. for more than one hour. With final solution annealing and subsequent quenching and natural aging at about room temperature for at least three days, the strips can be shipped in condition T4. Condition T6 is adjusted after quenching by artificial aging at temperatures between 100 and 220° C.

It is problematic that hot-rolled aluminium strips made from AlMgSi alloys contain coarse precipitates of $Mg_2Si$, which are broken up and reduced in size in the subsequent cold rolling due to their high degrees of deformation. Hot strips of an AlMgSi alloy are usually produced in thicknesses from 3 mm to 12 mm and then passed to a cold rolling stage with high degrees of deformation. Since the temperature range in which the AlMgSi phases are formed is passed through very slowly in conventional hot rolling, the phases produced thereby are very coarse. The temperature range for forming the phases referred to above depends on the alloy, but is between 550° C. and 230° C. It has been demonstrated experimentally that these coarse phases in the hot strip impair the elongation of the end product. This means that it has not previously been possible to fully exploit the formability characteristics of aluminium strips made from AlMgSi alloys.

The object underlying the present invention is therefore to provide a method for producing an aluminium strip from an AlMgSi alloy and an aluminium strip that has a higher elongation in the T4 state, and to this extent enables higher degrees of deformation when producing structured components for example. A further object underlying the invention is also to suggest advantageous uses for a metal sheet produced from the aluminium strip according to the invention.

SUMMARY OF THE INVENTION

According to a first teaching of the present invention, the object of a method for manufacturing a strip from an AlMgSi alloy as described in the preceding is solved in that immediately after the exit from the last hot rolling pass the hot strip has a temperature not exceeding 130° C., preferably a temperature not exceeding 100° C., and the hot strip is coiled at that temperature or a lower temperature.

It has been found that the size of the $Mg_2Si$ precipitations in a hot strip of an AlMgSi alloy may be reduced significantly by quenching, that is to say by accelerated cooling. By rapid cooling from a hot strip temperature between 230° C. and 550° C. to not more than 130° C., preferably not more than 100° C. at the output from the last hot rolling pass, the state of the hot strip's microstructure is frozen, so that coarse precipitations are no longer able to form. After solution annealing and quenching to obtain the final thickness, the resulting aluminium strip has significantly improved elongation with usual strengths in the T4 state, and the same or even better aging hardenability in the T6 state. This combination of properties has not been achieved previously with strips made from AlMgSi alloys.

According to an advantageous embodiment of the method according to the invention, this cooling operation is carried out within the last two hot rolling passes, that is to say the cooling to 130° C. and below takes place within seconds, and at all events not more than five minutes. It has been found that with this method the increased elongation values, with usual strength and yield point values in the T4 state, and the improved aging hardenability in the T6 state are achievable with a particularly high degree of process reliability.

According to a first embodiment of the method according to the invention, a particularly cost-effective arrangement for carrying out the method is provided if the hot strip is quenched by using at least one plate cooler and the hot rolling pass charged with emulsion itself to the coiling temperature. A plate cooler comprises an array of coolant and lubricant nozzles, which spray a rolling mill emulsion onto the aluminium strip. The plate cooler is often present in a hot rolling mill for the purpose of cooling rolled hot strips to the rolling temperature before the hot rolling stage and to set the coiling temperature. The method according to the invention may be carried out on conventional systems without any special additional equipment. By definition, the hot rolling temperature is higher than the recrystallisation temperature of a metal, which in the case of aluminium means it is higher than about 230° C. Though, according to the teaching of the present invention the coiling temperature at 130° C. is significantly below these standard conditions for the process.

If the hot rolling temperature of the hot strip is at least 230° C., preferably higher than 400° C. before the penultimate hot rolling pass, according to a next embodiment of the method according to the invention it is possible to ensure that particularly small $Mg_2Si$ precipitates are present in the quenched hot strip, since the predominating components of the alloy, magnesium and silicon, are present in the aluminium matrix in the dissolved state at these temperatures. This advantageous state of the hot strip is "frozen" as it were by the quenching step.

The thickness of the finished hot strip 3 mm to 12 mm, preferably 3.5 mm to 8 mm, which means that standard cold rolling mills may be used for the cold rolling.

The aluminium alloy used is preferably of alloy type AA6xxx, preferably AA6014, AA6016, AA6060, AA6111 or AA6181. A common property of all AA6xxx alloy types is that they have exceptionally good formability, characterized by high elongation values in the T4 state, and very high strengths or yield points in the T6 usable state, for example after artificial aging at 205° C./30 min.

According to a further embodiment of the method according to the invention, the finished, rolled aluminium strip is subjected to a heat treatment, in which the aluminium is heated to more than 100° C. and then coiled and aged at a temperature over 55° C., preferably over 85° C. This embodiment of the method makes it possible to implement after the natural aging a shorter heating phase with lower temperatures to adjust the T6 state in the aluminium strip or sheet, in which state the sheets or strips that have been shaped into components are used in the application. To do this, these rapidly aging aluminium strips are heated to temperatures of about 185° C. for just 20 minutes in order to reach the higher yield point values in the T6 state. Though, the breaking elongation values $A_{80}$ of the aluminium strips produced with this embodiment of the method according to the invention are slightly less than 29%. However, the aluminium strip produced according to the invention is noteworthy in that after aging in the T4 state it still has very good uniform elongation $A_g$ greater than 25%. The term uniform elongation $A_g$ refers to the maximum elongation of the specimen at which no sign of necking is observed during the stretching test. That is to say the specimen stretches evenly in the uniform elongation range. Previously, similar materials did not reach values for uniform elongation greater than 22% to 23%. Uniform elongation is a decisive factor in forming behavior, since it determines the maximum degree of deformation that may be applied to the material in practice. To this extent, the method according to the invention may thus be used to provide an aluminium strip with very good formability characteristics, and which may be converted to the T6 state with an accelerated artificial aging process (185° C./120 min.).

An aluminium alloy of type AA6016 includes the following alloy components, in the corresponding percentages by weight:

0.25%≤Mg≤0.6%,
1.0%≤Si≤1.5%,
Fe≤0.5%,
Cu≤0.2%,
Mn≤0.2%,
Cr≤0.1%,
Zn≤0.1%,
Ti≤0.1% the remainder being Al and unavoidable impurities, constituting not more than 0.15% in total and not more than 0.05% individually.

With magnesium contents of less than 0.25% by weight, the strength of the aluminium that is intended for structural applications is too low, but on the other hand formability deteriorates with magnesium contents higher than 0.6% by weight. Silicon and magnesium together are essentially responsible for the hardenablity of the aluminium alloy, and thus also for the high strengths that are achievable in the application case, for example after paint has been burned in. With Si contents lower than 1.0% by weight, the aging hardenability of the aluminium strip is reduced, so that in the application case only reduced strength properties are achievable. However, Si contents of more than 1.5% by weight result in casting problems with regard to the production of the rolling ingot. The Fe fraction should be limited to not more than 0.5% by weight in order to prevent coarse precipitations. Limiting the copper content to a maximum of 0.2% by weight results particularly in improved corrosion resistance of the aluminium alloy in the specific application. The manganese content of less than 0.2% by weight reduces the tendency to form coarser manganese precipitations. Although chromium is responsible for a fine microstructure, it must still be limited to 0.1% by weight, to also prevent coarse precipitations. In contrast, the presence of manganese improved the weldability of the aluminium strip according to the invention by reducing its tendency to crack and its sensitivity to quenching. A reduction in the zinc content to no more than 0.1% by weight particularly improves the corrosion resistance of the aluminium alloy or of the finished metal sheet in the respective application. In contrast, titanium provides for grain refinement during casting, but should be limited to not more than 0.1% by weight in order to ensure that the aluminium alloy is able to be cast easily.

An aluminium alloy of type AA6060 includes the following alloy ingredients, listed with their weight percent:

0.35%≤Mg≤0.6%,
0.3%≤Si≤0.6%,
0.1%≤Fe≤0.3%
Cu≤0.1%,
Mn≤0.1%,
Cr≤0.05%,
Zn≤0.10%,
Ti≤0.1% and the remainder being Al and unavoidable impurities, constituting not more than 0.15% in total and not more than 0.05% individually.

The combination of a precisely preset magnesium content with a lower Si content than was the case in the first embodiment and a closely specified Fe content yields an aluminium alloy, in which the formation of $Mg_2Si$ precipitations after hot rolling with the method according to the invention may be prevented particularly effectively, so that it is possible to produce a metal sheet having improved elongation and high yield points compared with metal sheets that are produced conventionally. The lower upper limits of the alloy components Cu, Mn and Cr further reinforce the effect of the method according to the invention. Regarding the effects of the upper limit for Zn and Ti, reference is made to the notes regarding the first embodiment of the aluminium alloy.

An aluminium alloy of type AA6014 includes the following alloy ingredients, listed with their weight percent:

0.4≤Mg≤0.8%,
0.3%≤Si≤0.6%,
Fe≤0.35%

Cu≤0.25%,
0.05%≤Mn≤0.20%,
Cr≤0.20%,
Zn≤0.10%,
0.05%≤V≤0.20%,
Ti≤0.1% and
the remainder being Al and unavoidable impurities, constituting not more than 0.15% in total and not more than 0.05% individually.

An aluminium alloy of type AA6181 includes the following alloy ingredients, listed with their weight percent:
0.6%≤Mg≤1.0%,
0.8%≤Si≤1.2%,
Fe≤0.45%
Cu≤0.10%,
Mn≤0.15%,
Cr≤0.10%,
Zn≤0.20%,
Ti≤0.1% and
the remainder being Al and unavoidable impurities, constituting not more than 0.15% in total and not more than 0.05% individually.

An aluminium alloy of type AA6111 includes the following alloy ingredients, listed with their weight percent:
0.5%≤Mg≤1.0%,
0.7%≤Si≤1.1%,
Fe≤0.40%
0.50%≤Cu≤0.90%,
0.15%≤Mn≤0.45%,
Cr≤0.10%,
Zn≤0.15%,
Ti≤0.1% and
the remainder being Al and unavoidable impurities, constituting not more than 0.15% in total and not more than 0.05% individually. Because of its higher copper content, the AA6111 alloy generally exhibits greater strength values in the T6 application state, but it must be classified as more susceptible to corrosion.

The alloy components of all of the aluminium alloys have been adapted specifically with regard to different applications. As was noted in the preceding, strips made from these aluminium alloys that have been produced according to the method according to the invention exhibit particularly high elongation values in the T4 state, combined with a particularly marked increase in the yield point for example following artificial aging at 205° C./30 min. This is also true for the aluminium strips in state T4 that have undergone solution annealing after a heat treatment.

According to a second teaching of the present invention, the object stated above is achieved by an aluminium strip constituted of an AlMgSi alloy in that the aluminium strip in the T4 state has a breaking elongation $A_{80}$ of at least 30% with an yield point Rp0.2 of 80 to 140 MPa. The shipment state T4 is usually achieved by solution annealing with quenching followed by storage at room temperature for at least three days, since by then the properties of the solution-annealed metal sheets or strips are stable. The combination of breaking elongation $A_{80}$ and yield point Rp0.2 of the aluminium strip according to the invention has not been achieved with the previously known AlMgSi alloys. The aluminium strip according to the invention thus enables maximum degrees of deformability due to the high elongation values with maximum values for the yield point Rp0.2 in the finished sheet and component.

One embodiment of the MgSi aluminium strip is endowed with particularly advantageous formability characteristics because additionally its uniform elongation $A_g$ is more than 25%. Uniform elongation is a decisive factor in determining the maximum degree of deformability of the aluminium strip and the metal sheet produced therefrom in component manufacturing, because it is imperative to avoid unchecked necking during manufacturing. The aluminium strip according to the invention has particularly high deformation capability with regard to necking and may therefore be formed to produce components with greater process reliability.

When in state T6, that is to say a state of readiness for use or application, the aluminium strip according to the invention preferably has an yield point Rp0.2 greater than 185 MPa for an elongation $A_{80}$ of at least 15%. These values were measured in aluminium strips produced according to the invention and in state T6, having undergone an artificial aging process at 205° C./30 min. following solution annealing and quenching (state T4). Because of its high yield points in state T6 and excellent elongation values in state T4, the aluminium strip according to the invention is particularly well suited for use in automotive construction, for example.

According to a further embodiment of the invention, the solution-annealed and quenched aluminium in state T6 following artificial aging at 205° C./30 min. has an yield point difference ΔRp0.2 between states T6 and T4 of at least 80 MPa. The increase in the yield point between state T4 and state T6 is particularly high for the aluminium strip according to the invention. The aluminium strip according to the invention therefore lends itself very well to forming in state T4, and may subsequently be transformed into a very strong usage state (state T6) by artificial aging. Given the necessary and highly complex forming operations and the high strength values and yield points demanded for example in the carbuilding industry, good hardenability is particularly advantageous for manufacturing complex components. A rapidly aged MgSi aluminium strip having outstanding formability properties may be produced when the aluminium strip produced according to the invention undergoes a solution annealing process followed by a heat treatment process after it is produced, and has a uniform elongation $A_g$ greater than 25% with an yield point Rp0.2 from 80 to 140 MPa in the T4 state. As was noted previously, with this variant it is possible to produce an MgSi aluminium strip that is capable of rapid aging and at the same time has very good formability. The artificial aging process to create the T6 state may be carried out at 185° C. for 20 min. to achieve the required yield point enhancements.

If, as in a further embodiment, the aluminium strip has a uniform elongation $A_g$ greater than 25% in the direction of rolling, transversely to the direction of rolling and diagonally to the direction of rolling, a particularly isotropic formability is enabled.

The aluminium strips preferably have a thickness from 0.5 mm to 12 mm. Aluminium strips having thicknesses from 0.5 mm to 2 mm are preferably used for bodywork parts in the carbuilding industry for example, whereas aluminium strips of greater thickness from 2 to 4.5 mm may be suitable for applications in chassis parts in carbuilding, for example. Single components having a thickness of up to 6 mm may also be produced in the cold strip. Besides these, aluminium strips having thicknesses even up to 12 mm may be used in specific applications. These very thick aluminium strips are normally only produced by hot rolling.

According to a further embodiment of the aluminium strip according to the invention, the aluminium alloy of the aluminium strip is of alloy type AA6xxx, preferably AA6014, AA6016, AA6060, AA6111 or AA6181. With regard to the advantages of these aluminium alloys, reference is made to the explanations of the method according to the invention.

Due to the outstanding combination of good formability in state T4, high resistance to corrosion and high values for the yield point Rp0.2 in the application state (state T6), the object stated above is solved in accordance with a third teaching of the present invention by the use of a metal sheet produced from an aluminium strip according to the invention as a component, a chassis or structural part and panel in automotive, aircraft or railcar construction, particularly as a component, a chassis part, outer or inner panel in carbuilding, preferably as a bodywork structural element. Above all visible bodywork parts, for example bonnets, fenders etc., also outer skin panels of a railcar or aircraft benefit from the high yield points Rp0.2 and good surface properties even after forming with high degrees of deformation.

There are many possible ways in which to refine and develop the method according to the invention and the aluminium strip according to the invention as well as the use of a metal sheet created therefrom. To this end, reference is made both to the claims subordinate to patent claims 1 and 6 and to the description of exemplary embodiments in conjunction with the drawing.

DETAILED DESCRIPTION OF THE INVENTION

Figure 1A:
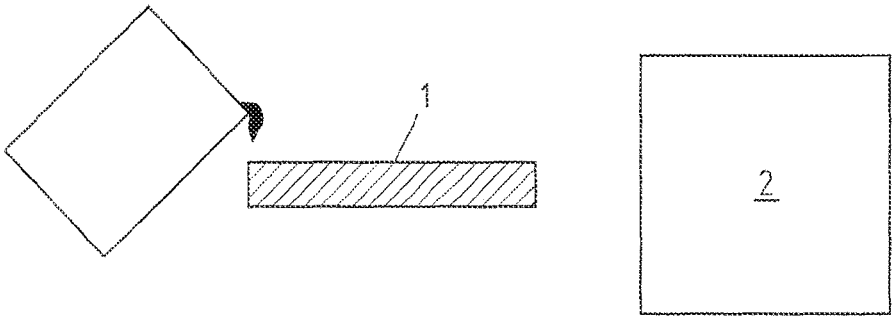
FIGS. 1*a*-1*d* illustrate schematically an exemplary of embodiment of a method according to the teachings of the present invention.

In the drawing, the only FIG. 1 shows a schematic flowchart of an exemplary embodiment of the method according to the invention for producing a strip made from an MgSi aluminium alloy in steps a) producing and homogenizing the rolling ingot, b) hot rolling, c) cold rolling and d) solution annealing with quenching.

First a rolling ingot is cast from an aluminium alloy having the following alloy components a percent by weight:

0.35%≤Mg≤0.6%,
0.3%≤Si≤0.6%,
0.1%≤Fe≤0.3%
Cu≤0.1%,
Mn≤0.1%,
Cr≤0.05%,
Zn≤0.1%,
Ti≤0.1% and the remainder being Al and unavoidable impurities, constituting not more than 0.15% in total and not more than 0.05% individually.

The rolling ingot made in this way is homogenized in a furnace 2 at a homogenizing temperature of about 550° C. for 8 h so that the alloying components are distributed completely homogeneously throughout the rolling ingot FIG. 1*a*).

Figure 1B:
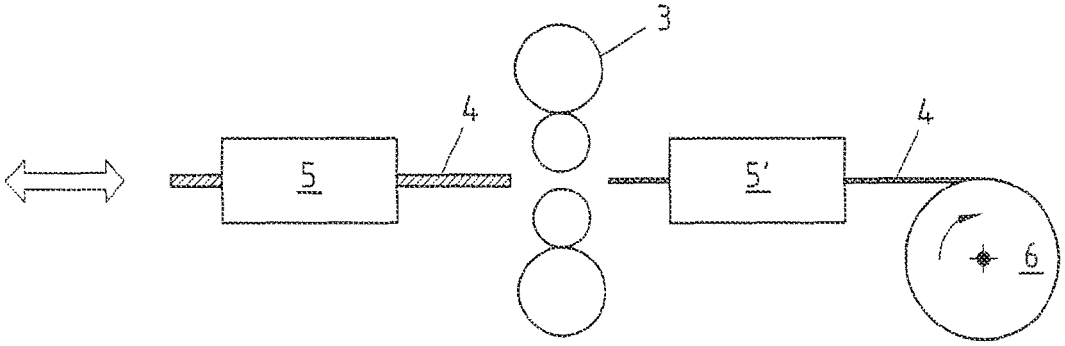
Figure 1C:
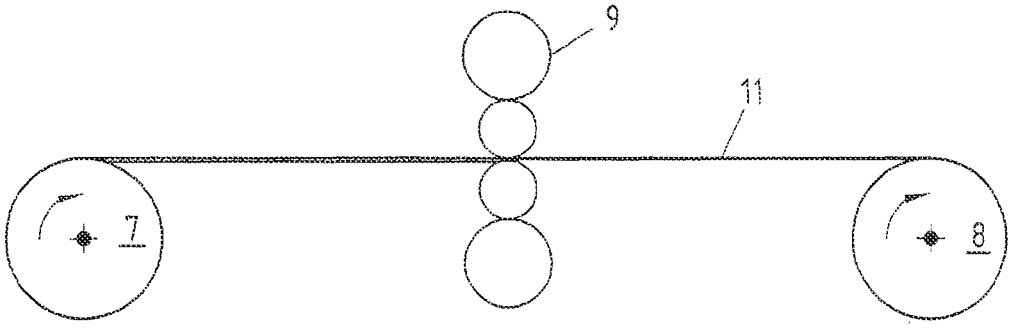
Figure 1D:
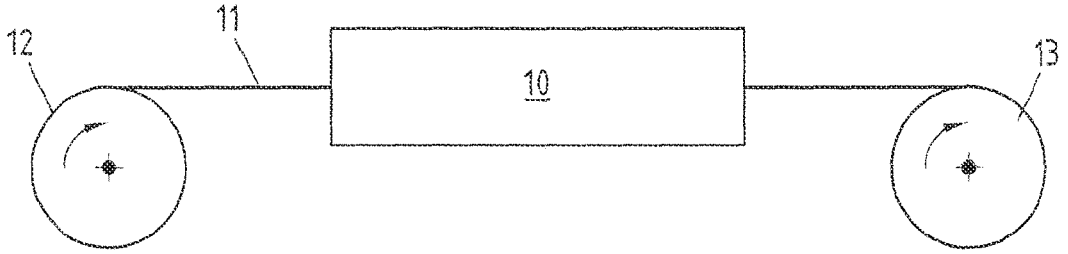

FIG. 1*b*) shows how rolling ingot in the present embodiment of the method according to the invention is hot rolled by reversing through a hot rolling mill 3, wherein the rolling ingot reaches a temperature from 230 to 550° C. during the hot rolling. In this embodiment, hot strip 4 preferably has a temperature of at least 400° C. after it leaves hot roller 3 and before the penultimate hot rolling pass. The quenching of warm strip 4 preferably takes place at this hot strip temperature of at least 400° C. using a plate cooler 5 and the working rollers of hot rolling mill 3. Plate cooler 5, which is shown only diagrammatically, sprays hot strip 4 with cooling rolling emulsion and ensure that hot strip 4 cools down quickly. The working rollers of roller mill 3 are loaded with emulsion and cool hot strip 4 further. After the last rolling pass, at the exit from plate cooler 5' in the present example, hot strip 4 has a temperature of just 95° C. and will then be coiled on recoiler 6.

Since hot strip 4 has a temperature not above 130° C. or not above 100° C. immediately at the exit from the last hot rolling pass or is optionally cooled to a temperature not above 130° C. or not above 100° C. in the last two hot rolling passes by the use of plate cooler 5 and the working rollers of hot rolling mill 3, the crystal microstructure of hot strip 4 is frozen, as it were, since no additional energy in the form of heat is available for subsequent precipitating steps. The hot strip, with a thickness of 3 to 12 mm, preferably 3.5 to 8 mm, is coiled on recoiler 6. As was explained previously, the coiling temperature in the present embodiment is below 95° C.

In the method according to the invention, now no or very few coarse $Mg_2Si$ precipitates are able to form in the coiled hot strip 4. Hot strip 4 has a crystalline state that lends itself very well to further processing and may be decoiled by decoiler 7, fed to a cold rolling mill 9, for example, and then coiled again on coiler 8, FIG. 1*c*).

The resulting, cold rolled strip 11 is coiled. It is then transported to solution annealing and quenching 10, FIG. 1*d*). For this purpose, it is decoiled again from coil 12, solution annealed in a furnace 10, quenched and returned to a coil 13. Then, after natural aging at room temperature, aluminium strip may then in state T4 be shipped with maximum formability. Alternatively (not shown), the aluminium strip 11 may be separated into individual sheets, which will then be available in state T4 after natural aging.

With larger aluminium strip thicknesses, for example for chassis applications or components such as backing plates, alternatively piecewise annealing may be carried out and the sheets quenched directly afterwards.

In state T6, the aluminium strip, or the aluminium panel, is heated to 100° C. to 220° C. g in an artificial aging process in order to obtain maximum values for the yield point. For example, artificial aging may be performed at 205° C./30 min.

The aluminium strips produced in accordance with the embodiment presented have, for example, a thickness of 0.5 to 4.5 mm after natural aging. Strip thicknesses from 0.5 to 2 mm are typically used for bodywork applications and strip thicknesses from 2.0 mm to 4.5 mm are used for chassis parts in car manufacturing. In both application areas, the improved elongation values represent a decisive advantage in parts manufacturing, since most operations with the sheets involve extensive forming but at the same time high strengths in the application state (T6) of the end product are imperative.

Table 1 shows the alloy compositions of aluminium alloys from which aluminium strips have been produced by conventional or inventive methods. Besides the contents of alloy components shown, the remaining composition of the aluminium strips is made up of aluminium and impurities, which are present in individual quantities not exceeding 0.05% by weight and altogether in a quantity not exceeding 0.15% by weight.

TABLE 1

| Strips | Si %/wt | Fe %/wt | Cu %/wt | Mn %/wt | Mg %/wt | Cr %/wt | Zn %/wt | Ti %/wt |
|---|---|---|---|---|---|---|---|---|
| 409 | 1.29 | 0.17 | 0.001 | 0.057 | 0.29 | <0.0005 | <0.001 | 0.02 |
| 410 | 1.30 | 0.17 | 0.001 | 0.056 | 0.29 | <0.0005 | <0.001 | 0.0172 |
| 491-1 | 1.39 | 0.18 | 0.002 | 0.062 | 0.30 | 0.0006 | 0.01 | 0.0158 |
| 491-11 | 1.40 | 0.18 | 0.002 | 0.063 | 0.31 | 0.0006 | 0.0104 | 0.0147 |

Strips (specimens) 409 and 410 were produced according to a method according to the invention in which in the last two hot rolling passes the hot strip was cooled from about 400° C. to 95° C. using a plate cooler and the hot rollers themselves and coiled. The measured values for this strips are marked "Inv." in Table 2. They were then cold rolled to a final thickness of 1.04 mm.

The strips (specimens) 491-1 and 491-11 were produced using a conventional hot rolling and cold rolling method and are identified with the label "Conv.".

The results of the mechanical properties presented in Table 2 clearly show the difference in achievable elongation values $A_{80}$.

Breaking elongation values $A_g$ and $Ag_{80}$, the yield point values Rp0.2 and the tensile strength values Rm in the following tablew were measured according to DIN EN.

The measured values were verified in state T4 by means of measurements taken on other strips. The aluminium alloy of strips A and B had the following composition:

0.25%≤Mg≤0.6%,
1.0%≤Si≤1.5%,
Fe≤0.5%,
Cu≤0.2%,
Mn≤0.2%,
Cr≤0.1%,
Zn≤0.1%,

TABLE 2

| | | | T4 | | | | T6 205° C./30 min. | | | |
|---|---|---|---|---|---|---|---|---|---|---|
| Strips | | Thickness (mm) | Rp0.2 (MPa) | $R_m$ (MPa) | $A_g$ (%) | $A_{80}$ (%) | Rp0.2 (MPa) | $R_m$ (MPa) | $A_{80}$ (%) | ΔRp0.2 (MPa) |
| 409 | Inv. | 1.04 | 100 | 220 | 26.3 | 31.3 | 187 | 251 | 16.2 | 87 |
| 410 | Inv. | 1.04 | 98 | 217 | 25.6 | 30.3 | 195 | 256 | 15.5 | 97 |
| 491-1 | Conv. | 1.04 | 92 | 202 | 23.1 | 27.8 | 180 | 235 | 14.7 | 88 |
| 491-11 | Conv. | 1.04 | 88 | 196 | 23.0 | 27.4 | 179 | 232 | 14.3 | 91 |

In order to achieve the T4 state, the strips underwent solution annealing with subsequent quenching followed by natural aging at room temperature. The T6 state was achieved with artificial aging at 205° C. for 30 minutes.

It was found that the advantageous microstructure that was created in strips 409 and 410 via the method according to the invention, not only offered a higher yield point Rp0.2 and increased strength Rm but also enabled increased elongation $A_{80}$. This microstructure results in a particularly advantageous combination of high breaking elongation $A_{80}$ of at least 30% or at least 30% with very high values for the yield point Rp0.2 from 80 to 140 MPa. In the state T6, the yield point may rise to more than 185 MPa, in which case the elongation $A_{80}$ still remains above 15%. The hardenability with a ΔRp0.2 of 87 or 97 MPa shows that the embodiments according to the invention exhibit a very good increase in the yield point of the artificially aged state T6 under artificial aging at 205° C./30 min. despite the increased elongation values of more than 15%.

A comparison of the uniform elongations $A_g$ of the strips according to the invention and of the conventional strips also shows that the uniform elongation $A_g$, with values of more than 25%, the inventive strips 409 and 410 significantly outperform the conventional strips, for which values of 23% were measured. Table 2 shows the value for uniform elongation transversely to the direction of rolling. Values greater than 25% for uniform elongation $A_g$ also diagonally and in the direction of rolling were also recorded on strips, not listed in the Table 2, which were measured with the method according to the invention. These results underscore the exceptional formability of the strips according to invention.

Ti≤0.1% the remainder being Al and unavoidable impurities, constituting not more than 0.15% in total and not more than 0.05% individually.

Strips A and B underwent quenching of the hot strip to 95° C. by application of the method according to the invention during the last two reduction phases and were coiled and then cold rolled to final thicknesses of 1.0 mm and 3.0 mm respectively. In order to achieve state T4, strips A and B were solution annealed and then naturally aged following quenching.

The following measured values were determined for the two strips:

TABLE 3

| | | T4 | | |
|---|---|---|---|---|
| Strips | Thickness (mm) | Rp0.2 (MPa) | $R_m$ (MPa) | $A_{80}$ (%) |
| A | 1.0 | 107 | 221 | 31.1 |
| B | 3.0 | 108 | 212 | 32.0 |

The further increase in elongation values $A_{80}$ shows how ideally suited these aluminium strips are for producing components in which very high degrees of deformation in state T4 during manufacturing must be combined with maximum tensile strengths Rm and yield points Rp0.2 in state T6.

In addition, an examination was made of other aluminium strips that had undergone additional heat treatment, which was carried out on the aluminium strip preferably immediately after the product was produced, for example directly after the solution annealing and quenching. For this, the aluminium strips were briefly heated to above 100° C. and then coiled at a temperature above 85° C., in the present case 88° C., and aged naturally.

Table 4 shows the composition of strip 342, which underwent the additional heat treatment after solution annealing and quenching.

TABLE 4

| Strip | Si %/wt | Fe %/wt | Cu %/wt | Mn %/wt | Mg %/wt | Cr %/wt | Zn %/wt | Ti %/wt |
|---|---|---|---|---|---|---|---|---|
| 342 | 1.3 | 0.17 | 0.00 | 0.06 | 0.3 | ≤0.0005 | ≤0.001 | 0.02 |

The heat treatment, called a pre-bake step, did lead to a worsening of the breaking elongation properties, since the breaking elongation $A_{80}$ was now below 30%. Surprisingly, the uniform elongation of aluminium strip P342 remained at over 25%, unchanged from the variant that did not undergo heat treatment, as is shown in Table 5. Uniform elongation is a very important factor in forming aluminium strip into a part, because improved uniform elongation enables higher degrees of deformation and thus either greater process reliability in manufacturing or fewer forming steps.

Table 5 shows various measured values. On the one hand, three measurements were taken at the start of the strip P342-BA and at the end of the strip P342-BE. The "State" column indicates that the strips were in state T4, that is to say they were solution annealed and quenched, and had undergone natural aging for 8 days at room temperature. The strips from the strip start and strip end were cut out and measured in the longitudinal direction (L), that is to say in the direction of rolling, transversely to the direction of rolling (Q), and diagonally to the direction of rolling (D). It was found that while there was a fall in breaking elongation values $A_{80\ mm}$ in some cases to below 30%, the uniform elongation $A_g$ still remained above 25% when measured in all directions and surprisingly was constant compared to the breaking elongation of the strip that had not under gone heat treatment.

TABLE 5

| Strip/ Position | State | Pos | $a_o$ (mm) | $R_{p0.2}$ (MPa) | $R_m$ (MPa) | $A_g$ % | $A_{80\ mm}$ % |
|---|---|---|---|---|---|---|---|
| P342-BA | T4 (8 d RT) | L | 1,009 | 97 | 209 | 25.3 | 28.9 |
| P342-BA | T4 (8 d RT) | Q | 1.006 | 90 | 206 | 25.5 | 28.5 |
| P342-BA | T4 (8 d RT) | D | 1.005 | 92 | 207 | 25.6 | 29.1 |
| P342-BE | T4 (8 d RT) | L | 1.002 | 95 | 208 | 25.9 | 30.1 |
| P342-BE | T4 (8 d RT) | Q | 1.000 | 89 | 204 | 25.3 | 28.3 |
| P342-BE | T4 (8 d RT) | D | 1.000 | 90 | 205 | 25.7 | 29.8 |

In a subsequent artificial aging step, the state T6 was reached after 20 minutes at 185° C. Typical values for the tensile yield point measured in state T6 were higher than 140 MPa after artificial aging and higher than 165 MPa after artificial aging following by further stretching of 2%. The aluminium strip prepared according to the invention that also underwent heat treatment, therefore combines to important properties. In the T4 state it is very readily deformable because of its high uniform elongation, and at the same time it reaches the desired strength after artificial aging at 185° C. for 20 min.

The invention claimed is:

1. An aluminum strip comprising a AlMgSi alloy, wherein the aluminum ally is one of the alloy type AA6014, AA6016, AA6060, AA6111, or AA6181 produced with a method comprising:

casting a rolling ingot;

homogenizing the rolling ingot;

hot rolling the rolling ingot using multiple hot rolling passes, the rolling ingot having been brought to a hot rolling temperature, and then optionally cold rolling the rolling ingot to a final thickness to produce a hot strip;

wherein a cooling operation is performed within the last two hot rolling passes using at least one plate cooler and an emulsion charged hot rolling pass itself, wherein the hot rolling passes are carried out by working rolls of a hot rolling mill, such that immediately after an exit from the last rolling pass from the hot rolling mill the hot strip has an exit temperature not above 130° C. and the hot strip is coiled at this or a lower temperature at the exit of the hot rolling mill to produce a finished rolled aluminum strip;

wherein the aluminum strip in a T4 state has a breaking elongation A80 of at least 30% with a yield point of Rp0.2 from 80 to 140 MPa; and wherein the aluminum strip is solution annealed and quenched such that the aluminum strip in the T6 state after artificial aging at 205° C./30 minutes has a yield point of Rp0.2 of more than 185 MPa.

2. The aluminum strip according to claim 1, wherein the hot rolling temperature of the hot strip is at least 230° C. before the penultimate hot rolling pass.

3. The aluminum strip according to claim 1, wherein the final thickness of the finished hot strip is 3 mm to 12 mm.

4. The aluminum strip according to claim 1, wherein the finished rolled aluminum strip is subjected to a heat treatment in which the finished rolled aluminum strip is heated to above 100° C. and is then coiled and aged at a temperature above 55° C.

5. The aluminum strip according to claim 1, wherein the aluminum strip in the T4 state has a uniform elongation Ag of more than 25%.

6. The aluminum strip according to claim 1, wherein the aluminum strip is solution annealed and quenched such that the aluminum strip in the T6 state after artificial aging at 205° C./30 minutes has an yield point difference ΔRp0.2 between states T6 and T4 of at least 80 MPa.

7. The aluminum strip according to claim 4, wherein the aluminum strip has a uniform elongation Ag of more than 25% with an yield point Rp0.2 of 80 to 140 MPa.

8. The aluminum strip according to claim 7, wherein the aluminum strip has a uniform elongation Ag of more than 25% in at least one of the direction of at rolling, transversely to the direction of rolling, and diagonally to the direction of rolling.

9. The aluminum strip according to claim 1, wherein the aluminum strip has a thickness of 0.5 to 12 mm.

10. The aluminum strip according to claim 1, wherein the aluminum strip has a uniform elongation Ag of more than 25% in at least one of the direction of at rolling, transversely to the direction of rolling, and diagonally to the direction of rolling.

11. The aluminum strip according to claim 1, wherein immediately after the exit from the last rolling pass the hot strip has an exit temperature not above 100° C. and the hot strip is coiled at this or a lower temperature to produce a finished rolled aluminum strip.

12. The aluminum strip according to claim 1, wherein the hot rolling temperature of the hot strip is above 400° C. before quenching during hot rolling, particularly before the penultimate hot rolling pass.

13. The aluminum strip according to claim 1, wherein the final thickness of the finished hot strip is 3.5 mm to 8 mm.

14. The aluminum strip according to claim 1, wherein the finished rolled aluminum strip is subjected to a heat treatment in which the finished rolled aluminum strip is heated to above 100° C. and is then coiled and aged at a temperature above 85° C.

15. A chassis element, structural element, a panel of an automobile, aircraft, or railcar, a component, an exterior or interior panel of a car, or a bodywork structural element made of an aluminum strip according to claim 1.

16. The aluminum strip according to claim 1, wherein the hot rolling temperature of the hot strip is at least 230° C. before quenching during hot rolling.

* * * * *